US005924620A

United States Patent [19]

Orikasa et al.

[11] Patent Number: 5,924,620

[45] Date of Patent: Jul. 20, 1999

[54] CONNECTION FILAMENT INSERTING APPARATUS

[75] Inventors: Yosuke Orikasa; Masaaki Imagawa; Keiichi Mitsuhashi, all of Togane, Japan

[73] Assignee: Ryokosha Co., Ltd., Tokyo, Japan

[21] Appl. No.: 08/898,439

[22] Filed: Jul. 22, 1997

[30] Foreign Application Priority Data

Jul. 25, 1996 [JP] Japan ..... 8-213247
May 6, 1997 [JP] Japan ..... 9-130534

[51] Int. Cl.[6] ..... B25C 1/00

[52] U.S. Cl. ..... 227/67; 112/222

[58] Field of Search ..... 227/67, 71; 112/222, 112/227; 24/90.1

[56] References Cited

U.S. PATENT DOCUMENTS

Re. 29,819 10/1978 Bone .
2,069,878 2/1937 Flood ..... 227/67
3,652,004 3/1972 Lozio ..... 227/67
3,895,753 7/1975 Bone .
4,040,555 8/1977 Jenkins .
4,455,858 6/1984 Hettich .
4,535,926 8/1985 Furutsu .
4,611,740 9/1986 Kunreuther .
4,785,868 11/1988 Koenig, Jr. .
5,588,575 12/1996 Davignon ..... 227/67
5,669,543 9/1997 Ueno ..... 227/67

*Primary Examiner*—Scott A. Smith
*Attorney, Agent, or Firm*—Dilworth & Barrese

[57] ABSTRACT

The connection filament inserting apparatus of the present invention is for inserting an anchor of a connection filament through an article, and comprises a hollow body having a front end, a rear end, and an inner space for accommodating the anchor, and a pointed conical portion formed at one end of the body. The hollow body has an opening formed at the rear end of the conical portion for releasing said anchor from the inner space of the body after the connecting filament inserting apparatus is passed through a structure.

13 Claims, 3 Drawing Sheets

CONNECTION FILAMENT INSERTING APPARATUS

BACKGROUND OF THE INVENTION

The present invention relates to a connection filament inserting apparatus for inserting a connection filament through clothes or the like in order to attach a tag with the connection filament to the clothes, and to a method for manufacturing the connection filament inserting apparatus.

FIGS. 6 to 8 show a connection filament inserting apparatus A disclosed in Japanese Patent, Second Publication, No. Sho 57-37506. The connection filament inserting apparatus A comprises a body 8 of a hollow needle-shape which has an opening 7, and a spoon-shaped tip 6 at one end of the body 8.

FIG. 9 shows the connection filament 1 when it is in use. The connection filament 1 comprises a filament body 1*a*, an anchor 1*b* formed at the one end of the filament body 1*a*, and a triangular connecting portion 1*c* to which a price tag or the like is attached. The filament body 1*a* and the anchor 1*b* are connected to form a T-shape.

When the connection filament 1 is attached to the clothes with the connection filament inserting apparatus A, the anchor 1*b* is inserted into the apparatus A in advance, the apparatus A is inserted through the clothes, the anchor 1*b* is pushed out from the opening 7 by a push rod 3, and the apparatus A is pulled out from the clothes. The anchor 1*b* is caught in the clothes to prevent the connection filament 1 from falling out from the clothes, and the tag is attached to the clothes.

With such a connection filament inserting apparatus A, the connection filament 1 can be easily attached to clothes. However, problems described below, arise in the insertion procedure. When the tip 6 is inserted through the clothes, the sharp edges 9 at both sides may cut the fibers of the clothes in a manner similar to a knife, and the clothes may thereby be damaged.

Furthermore, because the tip 6 has less bending strength because the sectional size at the tip 6 is small, the tip 6 may be accidentally bent or broken when the connection filament inserting apparatus A pierces the clothes. Such connection filament inserting apparatus A cannot be used for products through which it is difficult to pass the inserting apparatus, such as a stiff cloth, a carpet, and leather goods. If the tip 6 is bent and the opening 7 is deformed when the connection filament inserting apparatus A is used, the user may injure himself.

SUMMARY OF THE INVENTION

It is therefore an object of the present invention to provide a connection filament inserting apparatus which has sufficient strength and durability and which can be safely handled, and a method for manufacturing the connection filament inserting apparatus.

In order to accomplish the above object, the connection filament inserting apparatus of the present invention for inserting a T-shaped anchor of a connection filament through an article, comprising:

a hollow body having a front end, a rear end, and an inner space for accommodating the anchor; and a pointed conical portion formed at one end of the body;

wherein said hollow body has an opening formed at the rear end of the conical portion for releasing said anchor from the inner space of the body.

According to the apparatus, because the apparatus is inserted through the clothes so as to make the conical portion lead, which does not have any sharp edge, the clothes are not cut or damaged in the inserting procedure. Furthermore, because the sectional size at the conical portion is large, the conical portion has sufficient bending strength and durability and is prevented from being accidentally bent or broken. Accordingly, it is also possible to insert the apparatus through a stiff product and to safely handle the apparatus.

In the connection filament inserting apparatus according to another aspect of the present invention, the inside of the conical portion is filled with a filler forming a guide surface. The guide surface is preferably formed to rise from the inside face of the body and to extend to the edge of the opening. According to the apparatus, the anchor is guided by the guide surface so as to be smoothly released from the opening.

In the connection filament inserting apparatus according to another aspect of the present invention, the connection filament inserting apparatus further comprises a slit from the opening to the opposite end of the tip. According to this apparatus, the connection filament is removed smoothly through the slit.

In the connection filament inserting apparatus according to another aspect of the present invention, the apparatus further comprises a holder which is connected to the rear of the body. The user can thereby easily handle the apparatus.

In the connection filament inserting apparatus according to another aspect of the present invention, a method for manufacturing a connection filament inserting apparatus for inserting a T-shaped anchor of a connection filament through an article, comprising the steps of: stamping out a metal plate by a press die; bending the metal plate to form a hollow body having a front end, a rear end, an inner space for accommodating the anchor, and a pointed conical portion formed at one end of the body, wherein the hollow body has an opening formed at the rear side of the conical portion for releasing the anchor from the inner space of the body; immersing the conical portion in filler; and pulling up the conical portion in order to solidify the filler remaining in the conical portion so as to form a guide surface for guiding the anchor when the anchor is released from the opening.

DETAILED DESCRIPTION OF THE PREFERRED EMBODIMENTS

Referring to FIGS. 1 to 5, the embodiments of the connection filament inserting apparatus according to the present invention will be explained.

Figure 1:
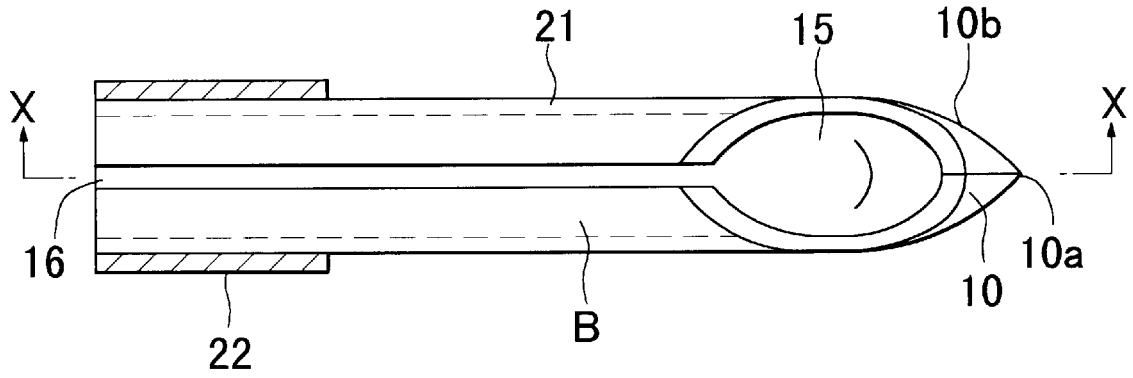
FIG. 1 shows an upper view of a connection filament inserting apparatus according to the present invention.
Figure 2:
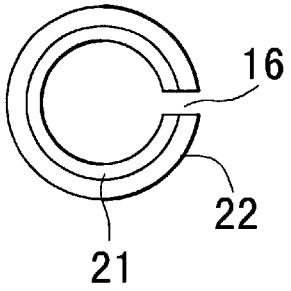
FIG. 2 is a rear view of the connection filament inserting apparatus according to the present invention.
Figure 3:
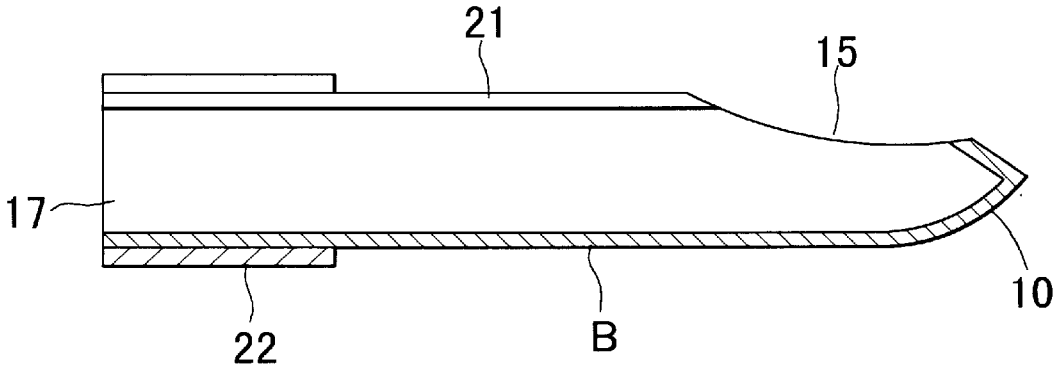
FIG. 3 is a cross section along the line X—X in FIG. 1.

FIGS. 1 to 3 show a connection filament inserting apparatus B according to the present invention. The connection filament inserting apparatus B comprises a body 21 of a hollow needle-shape having an inner space 17, and a pointed conical portion 10 formed at front end of the body 21. The body 21 has an elliptic opening 15 at a position closer to the conical portion 10.

The inside rim of the opening 15 is formed to be chamfered corner. The major axis of the opening 15 is set equal to the diameter of the body 21. The conical portion 10 comprises a conical face 10*b* which is slightly curved outside, and the sharp tip 10*a* which is surrounded by the conical face 10*b*. A slit 16 is formed at the upper side of the body 21 so as to extend from the opening 15 to the rear end of the body 21. The rear end of the body 21 is inserted into a cylinder-shaped holder 22, with which an operator can easily handle the connection filament inserting apparatus B.

When a tag with the connection filament 1 is attached to the clothes, the anchor 1*b* is inserted into the apparatus B in advance, the apparatus B is inserted through the clothes so as to make the conical portion 10 lead. After the anchor 1*b* is deeply inserted, the anchor 1*b* is pushed out from the opening 15 by a push rod (not shown), the apparatus B is pulled out from the clothes, and thus, the anchor 1*b* is caught in the clothes.

According to the present apparatus B, because the conical portion 10 lacks sharp edges and is inserted through the clothes first, the clothes are not cut or damaged. Furthermore, because the sectional size at the conical portion 10 is large, the conical portion 10 has sufficient bending strength and durability and is prevented from being accidentally bent or broken. It is also possible to insert the apparatus B through a tough product, such as a stiff cloth, a carpet, and leather goods, and to safely handle the apparatus B.

Figure 4:
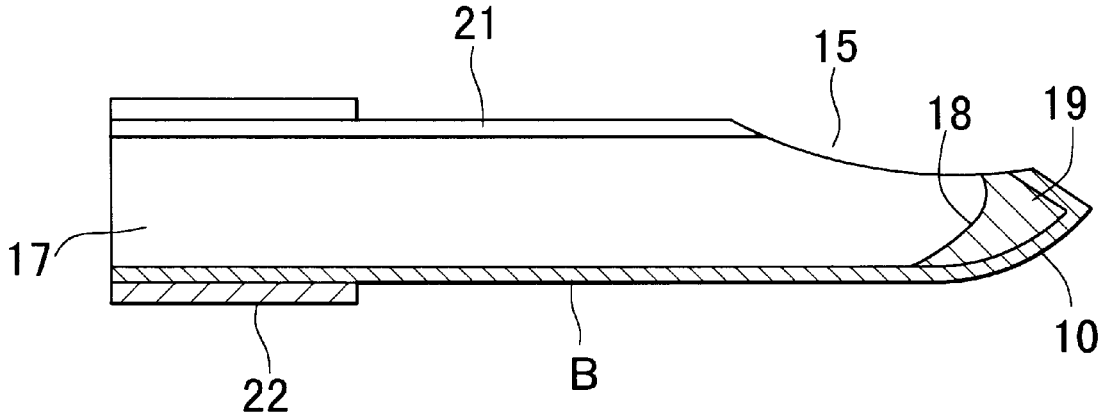
FIG. 4 is a cross section of the connection filament inserting apparatus in which the conical portion thereof is filled with a filler according to the present invention.

When the anchor 1*b* is shorter than the width of the opening 15 and can be smoothly released from the opening 15, the inside of the conical portion 10 may be hollow. If the anchor 1*b* is longer than the width of the opening 15, it may be caught at the edge of the opening 15, the inside of the conical portion 10 is preferably filled with the filler 19 such as hard plastic or fusible metal as shown in FIG. 4. The filler 19 is formed to have a guide surface 18 which rises from the inside face of the body 21 and extends to the edge of the opening 15.

When the connection filament 1 is inserted through the clothes with the apparatus B, the anchor 1*b* is pushed out by the push rod. In this procedure, the anchor 1*b* is guided by the guide surface 18 so as to be smoothly released from the opening 15.

Figure 5:
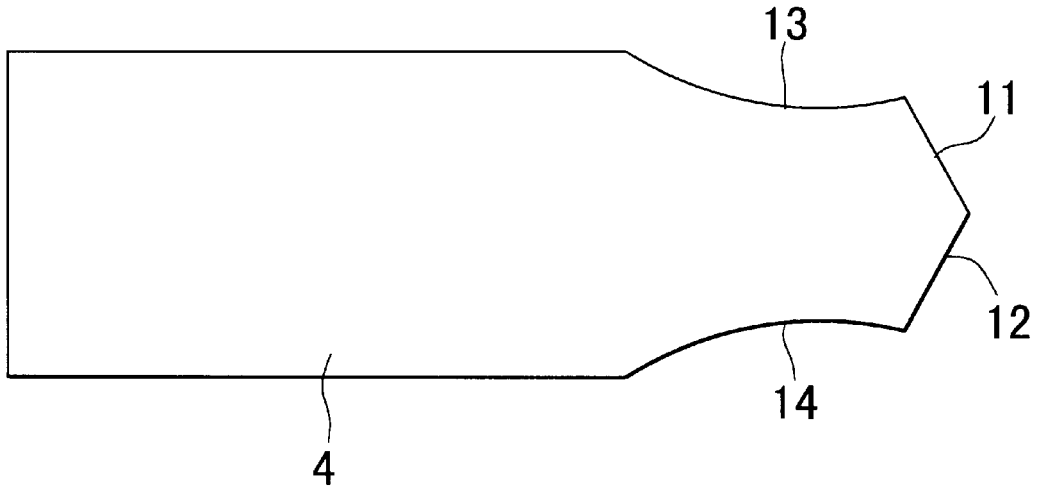
FIG. 5 is a metal plate as a material for the body of the connection filament inserting apparatus according to the present invention.
Figure 6:
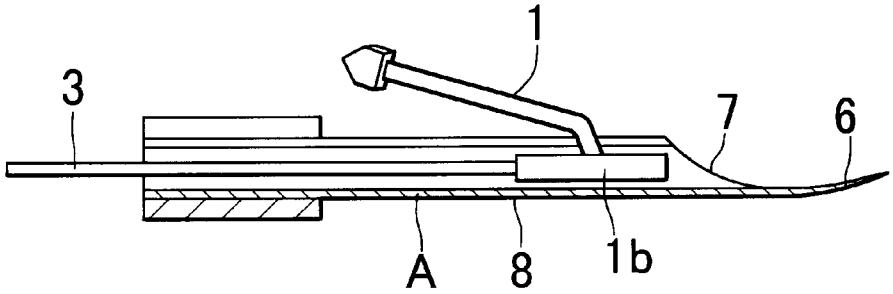
FIG.6 (Prior Art)
FIG. 6 is a cross section of a connection filament inserting apparatus of the prior art.
Figure 7:
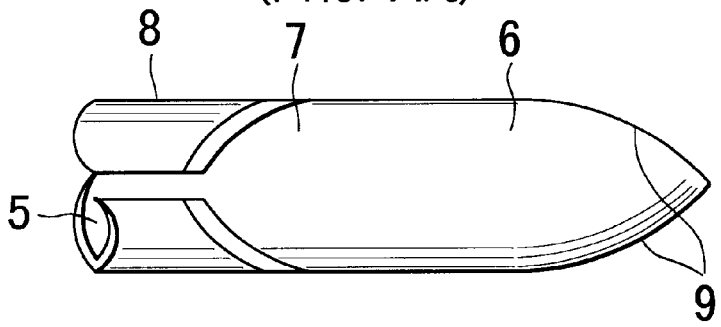
FIG.7 (Prior Art)
FIG. 7 is an upper view of the tip of the connection filament inserting apparatus of the prior art.
Figure 8:
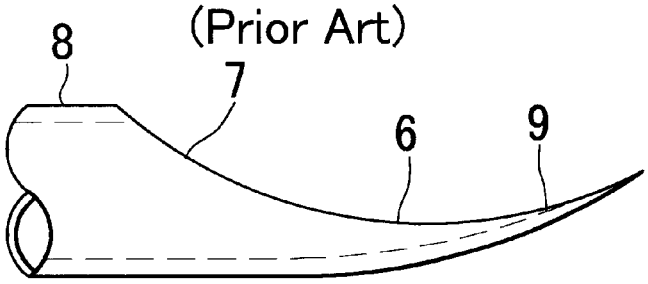
FIG.8 (Prior Art)
FIG. 8 is an side view of the tip of the connection filament inserting apparatus of the prior art.
Figure 9:
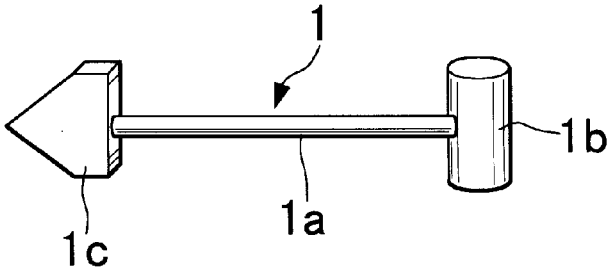
FIG. 9 is a perspective view of a connection filament currently in use.

A method for manufacturing the connection filament inserting apparatus B will be explained. First, a metal plate 4 of a halberd-shape as shown in FIG. 5, is stamped out by a press die. The shape of the metal plate 4 comprises left and right tip edges 11 and 12 which form a sharp tip, and left and right side edges 13 and 14 which are curved toward the inside.

The metal plate 4 is bent by press working and the left and right tip edges 11 and 12 are joined so that the hollow body 21 is formed. The opening 15 is formed by the left and right side edges 13 and 14 on the upper side of the body 21, and the slit 16 is formed at the seam of the upper side of the body 21. The body 21 is inserted into the holder 22.

In order to fill the inside of the conical portion 10 with the filler 19 such as hard plastic or fusible metal, the conical portion 10 is immersed in melted plastic or metal such as lead, tin, or an alloy of lead and tin. The conical portion 10 is pulled up, and the filler solidifies in the conical portion 10 so that the guide surface 18 is formed.

In order to make the surface of the filler 19 concave and smooth, the material of the filler 19 and the metal plate 4 may be appropriately selected. In the present embodiment, the metal plate 4 is made of stainless steel in view of workability and hardenablity. The metal material is not limited, and the other metal material having appropriate workability, hardenablity, and adhesion, can be also applied. In addition, when hard plastic is used as the filler 19, insertion injection molding method generally used in the process of metal material, can be also applied.

While the preferred embodiment of the invention has been described above, it will be understood that various modifications may be made thereto, and the invention is intended to cover with the appended claims all such modifications as may fall within the true spirit and scope of the invention.

What is claimed is:

1. A connection filament inserting apparatus for inserting an anchor of a connection filament through an article, comprising:

a hollow body having a front end, a rear end, and an inner space for accommodating said anchor, said hollow body being formed from a metal plate; and a pointed conical portion formed at one end of said body;

wherein said hollow body has an opening for releasing said anchor from said inner space of said body, said opening being formed in said conical portion, the inside of said conical portion being filled with a fusible filler forming a guide surface for guiding said anchor.

2. The connection filament inserting apparatus according to claim 1, wherein said guide surface rises from the inside face of said body and extends to the edge of said opening.

3. The connection filament inserting apparatus according to claim 2, wherein said guide surface is substantially smooth and curves upwardly.

4. The connection filament inserting apparatus according to claim 1, further comprising a slit, extending from said opening to said rear end of said body, through which said connection filament passes.

5. The connection filament inserting apparatus according to claim 1, further comprising a holder which is connected to said rear end of said body.

6. The connection filament inserting apparatus according to claim 1 wherein said guide surface is formed by immersing said conical portion in melted filler and by solidifying said filler remaining in said conical portion.

7. The connection filament inserting apparatus according to claim 1, wherein said filler is hard plastic.

8. The connection filament inserting apparatus according to claim 1, wherein said filler is fusible metal.

9. The connection filament inserting apparatus according to claim 1, wherein said hollow body is formed by stamping out said metal plate by a press die and bending said metal plate.

10. The connection filament inserting apparatus according to claim 9, wherein said guide surface is formed by immersing said conical portion in melted filler and by solidifying said filler remaining in said conical portion.

11. The connection filament inserting apparatus according to claim 1, wherein said guide surface is formed to rise from an inside face of said hollow body and to extend to the edge of the opening.

12. The connection filament inserting apparatus according to claim 11, wherein said guide surface is arranged to guide the anchor of the filament so as to be smoothly released from the opening upon ejection.

13. The connection filament inserting apparatus according to claim 1, wherein an inside rim of the opening is formed to be a chamfered corner.

* * * * *